US006220252B1

(12) United States Patent
Heintz

(10) Patent No.: US 6,220,252 B1
(45) Date of Patent: Apr. 24, 2001

(54) EYELASH CURLING APPARATUS

(76) Inventor: Joy A. Heintz, 45 North St., Essex Junction, VT (US) 05452

( * ) Notice: Subject to any disclaimer, the term of this patent is extended or adjusted under 35 U.S.C. 154(b) by 0 days.

(21) Appl. No.: 09/480,360

(22) Filed: Jan. 10, 2000

(51) Int. Cl.[7] ..... A45D 2/48; A45D 40/30; A45D 40/26

(52) U.S. Cl. ..... 132/217; 132/216; 132/218

(58) Field of Search ..... 132/217, 216, 132/218, 223, 317, 318, 320

(56) References Cited

U.S. PATENT DOCUMENTS

| | | | | |
|---|---|---|---|---|
| 1,925,266 | * | 9/1933 | Manning | 132/217 |
| 2,004,046 | * | 6/1935 | Glaser et al. | 132/217 |
| 2,133,042 | * | 10/1938 | Risberg | 132/217 |
| 2,134,731 | * | 11/1938 | Palmer | 132/217 |
| 4,784,165 | * | 11/1988 | Stein | 132/217 |
| 5,377,700 | * | 1/1995 | Harris | 132/217 |
| 5,524,649 | * | 6/1996 | Suh | 132/217 |
| 5,685,324 | * | 11/1997 | Huang | 132/217 |
| 5,944,028 | * | 8/1999 | Gebhard | 132/217 |
| 5,960,799 | * | 10/1999 | Suh | 132/217 |
| 6,105,585 | * | 8/2000 | Thomas | 132/217 |

FOREIGN PATENT DOCUMENTS

| | | | | |
|---|---|---|---|---|
| 1072388 | * | 9/1954 | (FR) | 132/217 |

* cited by examiner

*Primary Examiner*—John J. Wilson
*Assistant Examiner*—Robyn Kieu Doan

(57) ABSTRACT

The eyelash curling apparatus is designed to provide an apparatus that allows the user to curl the lashes instead of crimping them. The apparatus is a small tool having a plurality of parts. The top portion of the apparatus is of concave design to accommodate the placement of the apparatus on the eyeball of the user. Attached to this part is a round rod that is positioned centrally to and horizontally to the concave surface. The rod is implanted in a housing that acts as a curling iron. Once heated to the proper temperature the lashes are placed between the top and lower structures. Pinching the two structures together, closes the mechanism, forces the eyelashes against the curling rod, keeping them positioned during the set time.

8 Claims, 1 Drawing Sheet

EYELASH CURLING APPARATUS

BACKGROUND OF THE INVENTION

This invention pertains to personal grooming devices, in particular, to an eyelash curling apparatus for use by individuals to permit the curling of their eyelashes without pinching or crimping the eyelash.

There are a number of devices on the market that are designed to curl lashes. Most of them however accomplish this by crimping the lash which can be painful, pull the lash and the eyelid and result in an eyelash that has an angle crimped into it. This is because the current curling bar is a flat unit that crimps lashes at a ninety degree angle. The mechanism can entrap the eyelid and pinch it this action can tear the makeup that is already applied as well as causing pain. The current apparatus is large, bulky and consumes a large percentage of the cosmetic bag. Also, it has an negative appearance and is not something that one likes to appear with in public. Prior art typically describes a scissors like device which uses indirect force, causing the user to use considerable force while crimping the lashes.

What is needed is an eyelash curling apparatus that uses a curve in the shape of the eye's natural shape. It is the object of this invention to teach an eyelash curling apparatus which avoids the disadvantages and limitations, recited above in previous eyelash curling devices. It is the object of this invention is provide an apparatus that is inexpensive to manufacture, can be easily used and set up by the user and, at the same time, accurate and highly effective.

SUMMARY OF THE INVENTION

Particularly, it is the object of this invention to teach an eyelash curling apparatus, for use by individuals in order to provide a curled eyelash without the necessity of using indirect force or crimping to get the desired results, comprising a housing; said housing having two sections, an upper unit and a lower unit; said upper unit and said lower units of said housing comprising units of concave design for positioning of said housing on the eyeball; said upper unit of said housing having an arcuate rod positioned horizontally across the base edge of said upper unit; said housing having spring loaded connection means for attaching said upper unit and said lower unit; and said lower unit having receiving means for receiving said arcuate rod in said upper unit.

It is also the object of this invention to teach an eyelash curling apparatus, for use by individuals in order to provide a curled eyelash without the necessity of using indirect force or crimping to get the desired results, comprising in combination a housing having a primary and a secondary unit, said primary unit and said secondary unit of said housing comprising units of concave design for positioning of said housing on the eyeball, said primary unit of said housing having an arcuate rod positioned horizontally across the base edge; said housing having spring loaded connection means for attaching said primary and said secondary units; and said secondary unit having receiving means for receiving said arcuate rod in said primary unit.

BRIEF DESCRIPTION OF THE DRAWINGS

Further objects and features of this invention will become more apparent by reference to the following description taken in conjunction with the following figures, in which.

DETAILED DESCRIPTION OF THE PREFERRED EMBODIMENT

Figure 1:
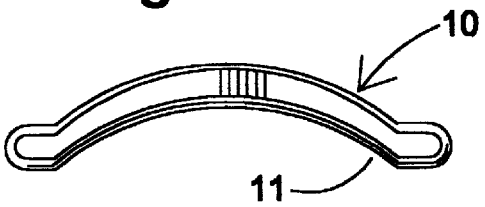
FIG. 1 is a top plan view of the novel eyelash curling apparatus.
Figure 2:
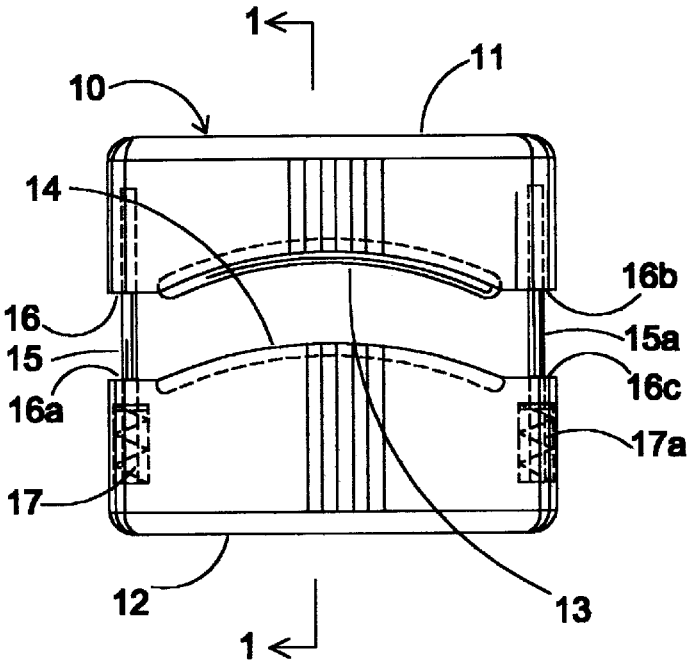
FIG. 2 is a front elevational view thereof.
Figure 3:
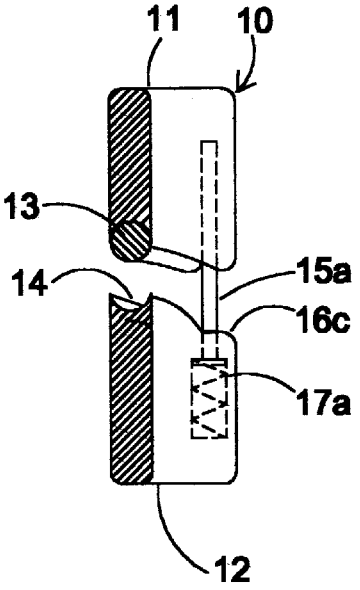
FIG. 3 is a cross sectional view of the novel eyelash curling apparatus taken along line 3—3 of FIG. 2.

As shown in the figures, the novel eyelash curling apparatus 10 comprises a unit with an upper housing 11 and a lower housing 12. The upper and the lower housings have a concave surface design in order to accommodate the placement of the device over the eyeball. The housing 11 and 12 are constructed of lightweight plastic. A metal rod 13 is implanted in the upper housing 11, but is designed to fit into a groove 14 in the lower housing 12. The metal rod is heated to a desired level and acts as the curling iron when the two housings are squeezed together. The upper and lower housings 11 and 12 are held in a single element by means of two pins 15 and 15*a* that are located in apertures 16, 16*a*, 16*b* and 16*c* in the upper and lower housing 11 and 12. Each of the pins 15 and 15*a* are spring loaded 17 and 17*a* in order to provide a resilient force to the apparatus.

In operation, the individual using the eyelash curling apparatus will heat the metal rod that is located within the upper housing which acts as the curling iron. When it is heated to the desired level, the eyelashes are placed between the upper and lower housings. The apparatus is positioned using the thumb and forefinger of one hand. Squeezing the upper and lower housings together closes the mechanism. When the lower housing meets the upper housing, the metal rod in the upper housing is encased in the groove of the lower housing in the shape of a capital C. This action forces the eyelashes against the metal rod and keeping the eyelashes in position during the time it takes to curl the eyelash. The small, lightweight design of the apparatus allows the user to actually clearly see the application of the device in the mirror. Many of the earlier devices were large enough to obscure the view of the user. The heat for the metal rod can be acquired by using a blow dryer or immersing the upper housing in hot water.

While I have described my invention in connection with specific embodiments thereof, it is clearly to be understood that this is done only by way of example and not as a limitation to the scope of my invention as set forth in the objects thereof and in the appended claims.

I claim:

1. A eyelash curling apparatus, for use by individuals in order to provide a curled eyelash without the necessity of using indirect force or crimping to get the desired results, comprising;

a housing;

said housing having two sections, an upper unit and a lower unit;

said upper unit and said lower units of said housing comprising units of concave design for positioning of said housing on an eyeball;

said upper unit of said housing having an arcuate rod positioned horizontally across a base edge of said upper unit;

said housing having spring loaded connection means for attaching said upper unit and said lower unit; and said lower unit having receiving means for receiving said arcuate rod in said upper unit.

2. An eyelash curling apparatus, according to claim 1, wherein:

said housing comprises a unit of rigid construction.

3. An eyelash curling apparatus, according to claim 2, wherein:

said housing comprises a unit constructed of metallic materials.

4. An eyelash curling apparatus, according to claim 2, wherein:

said housing further comprises a unit constructed of plastic materials.

5. An eyelash curling apparatus, according to claim 2, wherein:

said housing further comprises a unit of composite construction.

6. An eyelash curling apparatus, according to claim 1, wherein:

said arcuate rod comprises a unit of metallic construction for providing an element to be heated in order to allow said apparatus to curl the eyelash.

7. An eyelash curling apparatus, according to claim 1, wherein:

said spring loaded connection means comprises pins inserted into apertures positioned at the ends of said housing; and said pins having springs positioned at one end for providing a release mechanism for said upper and lower units of said housing when they are squeezed together.

8. An eyelash curling apparatus, according to claim 1, wherein:

said receiving means in said lower unit of said housing comprises an arcuate groove in the top edge of said lower portion of said housing for receiving said arcuate rod located in said bottom edge of upper unit of said housing.

* * * * *